US006258766B1

(12) United States Patent
Romack et al.

(10) Patent No.: US 6,258,766 B1
(45) **Date of Patent: *Jul. 10, 2001**

(54) DRY CLEANING METHODS AND COMPOSITIONS

(75) Inventors: Timothy J. Romack, Durham; David F. Cauble, Charlotte; James B. McClain, Raleigh, all of NC (US)

(73) Assignee: MiCell Technologies, Inc., Raleigh, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/766,782

(22) Filed: Jan. 22, 2001

Related U.S. Application Data

(63) Continuation of application No. 09/234,145, filed on Jan. 19, 1999, now Pat. No. 6,200,352, which is a continuation-in-part of application No. 09/140,867, filed on Aug. 27, 1998, now abandoned, which is a continuation-in-part of application No. 08/921,620, filed on Aug. 27, 1997, now Pat. No. 5,858,022.

(51) Int. Cl.[7] ..... D06L 1/00; D06L 1/02

(52) U.S. Cl. ..... 510/291; 510/285; 510/289; 510/290; 510/407; 8/142

(58) Field of Search ..... 8/142, 137, 158, 8/159, 149.1, 149.2; 510/285, 291, 289, 290, 407

(56) References Cited

U.S. PATENT DOCUMENTS

| | | | | |
|---|---|---|---|---|
| 2,524,590 | | 10/1950 | Boe . | |
| 3,694,546 | | 9/1972 | Roth et al. . | |
| 4,139,607 | | 2/1979 | Simons et al. . | |
| 4,161,458 | | 7/1979 | Kolleth . | |
| 4,219,333 | | 8/1980 | Harris | 8/137 |
| 4,243,548 | | 1/1981 | Heeb et al. . | |
| 4,912,793 | | 4/1990 | Hagiwara | 8/158 |
| 4,970,093 | | 11/1990 | Sievers et al. . | |
| 5,169,433 | | 12/1992 | Lindsay et al. . | |
| 5,178,871 | | 1/1993 | Thill | 525/405 |
| 5,267,455 | | 12/1993 | Dewees et al. | 68/5 C |
| 5,279,615 | | 1/1994 | Mitchell et al. | 8/142 |
| 5,301,664 | | 4/1994 | Sievers et al. . | |
| 5,370,742 | * | 12/1994 | Mitchell et al. | 134/10 |
| 5,377,705 | | 1/1995 | Smith, Jr. et al. | 134/95.3 |
| 5,412,958 | | 5/1995 | Iliff et al. | 68/5 C |
| 5,431,843 | | 7/1995 | Mitchell et al. | 252/186.38 |
| 5,467,492 | | 11/1995 | Chao et al. | 8/159 |
| 5,486,212 | | 1/1996 | Mitchell et al. | 8/142 |
| 5,669,251 | | 9/1997 | Townsend et al. | 68/58 |
| 5,676,705 | | 10/1997 | Jureller et al. | 8/142 |
| 5,683,473 | | 11/1997 | Jureller et al. | 8/142 |
| 5,683,977 | | 11/1997 | Jureller et al. | 510/286 |
| 5,759,209 | | 6/1998 | Adler et al. | 8/142 |
| 5,858,022 | | 1/1999 | Romack et al. | 8/142 |
| 5,977,045 | | 11/1999 | Murphy | 510/289 |
| 6,001,133 | * | 12/1999 | DeYoung et al. | 8/142 |
| 6,051,421 | * | 4/2000 | Sauer et al. | 435/283.1 |
| 6,200,352 | * | 3/2001 | Romack et al. | 8/142 |
| 6,200,943 | * | 3/2001 | Romack et al. | 510/285 |

FOREIGN PATENT DOCUMENTS

| | | | |
|---|---|---|---|
| 39 04 514 A1 | | 8/1990 | (DE) . |
| 0 518 653 A1 | | 12/1992 | (EP) . |
| 0 732 154 A1 | | 9/1996 | (EP) . |
| WO 94/01613 | | 1/1994 | (WO) . |
| WO 96/27704 | | 9/1996 | (WO) . |
| WO 97/16264 A1 | * | 5/1997 | (WO) . |
| WO 97/16264 | | 5/1997 | (WO) . |
| WO 98/34595 | | 8/1998 | (WO) . |

OTHER PUBLICATIONS

Manfred Wentz; Textile Cleaning with Carbon Dioxide?; Copyright© 1995 By R.R. Street & Co., Inc. (month unknown).

International Search Report, dated Oct. 12, 1998 for PCT/US 98/17730.

Abstract XP–002085400; NCSU College of Textiles' Researcher Develops Environmentally Sound $C0_2$ Dry Cleaning, *Southern Textile News*, 53(33:12):1 page, Aug. 25, 1997.

Abstract XP–002085399; DeSimone et al.; Design and Utilization of Surfactants for $C0_2$, 213$^{th}$ ACS National Meeting, Apr. 13–17, 1997.

* cited by examiner

*Primary Examiner*—Alan Diamond
(74) *Attorney, Agent, or Firm*—Myers Bigel Sibley & Sajovec

(57) ABSTRACT

A method for dry-cleaning articles such as fabrics and clothing in carbon dioxide comprises contacting an article to be cleaned with a liquid dry cleaning composition for a time sufficient to clean the fabric. The liquid dry-cleaning composition comprises a mixture of carbon dioxide, a surfactant, and an organic co-solvent. After the contacting step, the article is separated from the liquid dry cleaning composition. The method is preferably carried out at ambient temperature. The surfactant is preferably one that does not contain a $CO_2$-philic group. The organic co-solvent is preferably an alkane and has a flash point above 140° F.

7 Claims, No Drawings

DRY CLEANING METHODS AND COMPOSITIONS

This application is a continuation of commonly owned, application Ser. No. 09/234,145, filed Jan. 19, 1999, now U.S. Pat. No. 6,200,352 which is a continuation-in-part of commonly owned, application Ser. No. 09/140,867, filed Aug. 27, 1998, now abandoned which is a continuation-in-part of commonly owned, patent application Ser. No. 08/921,620, filed Aug. 27, 1997, now issued as U.S. Pat. No. 5,858,022, the disclosures of which are incorporated by reference herein in their entirety.

FIELD OF THE INVENTION

The present invention relates to methods and compositions for carrying out the dry-cleaning of fabrics (e.g., garments) in liquid carbon dioxide.

BACKGROUND OF THE INVENTION

Commercial dry cleaning systems currently employ potentially toxic and environmentally harmful halocarbon solvents, such as perchloroethylene. Carbon dioxide has been proposed as an alternative to such systems in U.S. Pat. No. 4,012,194 to Maffei. A problem with carbon dioxide is, however, its lower solvent power relative to ordinary solvents.

German Patent Application DE3904514 A1, published Aug. 23, 1990, describes a cleaning system combining various conventional anionic or nonionic surface active agents with supercritical $CO_2$. The system described therein appears to combine the detergency mechanism of conventional surface active agents with the solvent power of supercritical fluid carbon dioxide. A carbon dioxide dry cleaning system effective for liquid carbon dioxide is not provided.

U.S. Pat. No. 5,683,473 to Jureller et al. (see also U.S. Pat. No. 5,683,977 to Jureller et al.) describes a dry cleaning system utilizing carbon dioxide in liquid form in combination with surfactants that contain a functional moiety that is $CO_2$-philic, which surfactants are not conventionally used for detergent cleaning. Since there are numerous advantages to employing conventional surfactants (e.g., cost, ready availability, established regulatory approval, established toxicology, etc), it would be extremely desireable to have a dry cleaning system for liquid carbon dioxide that employs conventional surfactants that do not contain a $CO_2$-philic group.

U.S. Pat. No. 5,377,705 to Smith et al. describes a precision cleaning, system in which a work piece is cleaned with a mixture of $CO_2$ and a co-solvent. Smith provides an entirely non-aqueous system, stating: "The system is also designed to replace aqueous or semi-aqueous based cleaning processes to eliminate the problems of moisture damage to parts and water disposal" (col. 4 line 68 to col. 5 line 3). Co-solvents that are listed include acetone and ISOPAR™ M (col. 8, lines 19–24). Use in dry cleaning is neither suggested nor disclosed.

In view of the foregoing, there is a continuing need for effective carbon dioxide-based dry cleaning systems.

SUMMARY OF THE INVENTION

A method for dry-cleaning articles such as fabrics and clothing in carbon dioxide comprises contacting an article to be cleaned with a liquid dry cleaning composition for a time sufficient to clean the fabric. The liquid dry-cleaning composition comprises a mixture of carbon dioxide, a surfactant, and an organic co-solvent. After the contacting step, the article is separated from the liquid dry cleaning composition.

Preferably, the liquid dry cleaning composition is at ambient temperature, of about 0° C. to 30° C. The surfactant is soluble in the co-solvent. The surfactant may or may not be soluble in the $CO_2$. Hence, in one embodiment; the surfactant may contain a $CO_2$-philic group. However, in the preferred embodiment, the surfactant does not contain a $CO_2$-philic group. Hence, an advantage of the present invention is that, by proper use of the co-solvent, conventional surfactants may be employed in a liquid carbon dioxide dry cleaning system.

DETAILED DESCRIPTION OF THE INVENTION

The term "clean" as used herein refers to any removal of soil, dirt, grime, or other unwanted material, whether partial or complete. The invention may be used to clean nonpolar stains (i.e., those which are at least partially made by nonpolar organic compounds such as oily soils, sebum and the like), polar stains (i.e., hydrophilic stains such as grape juice, coffee and tea stains), compound hydrophobic stains (i.e., stains from materials such as lipstick and candle wax), and particulare soils (i.e., soils containing insoluble solid components such as silicates, carbon black, etc.).

Articles that can be cleaned by the method of the present invention are, in general, garments and fabrics (including woven and non-woven) formed from materials such as cotton, wool, silk, leather, rayon, polyester, acetate, fiberglass, furs, etc., formed into items such as clothing, work gloves, rags, leather goods (e.g., handbags and brief cases), etc.

Liquid dry-cleaning compositions useful for carrying out the present invention typically include water. The source of the water is not critical in all applications. The water may be added to the liquid solution before the articles to be cleaned are deposited therein, may be atmospheric water, may be the water carried by the garments, etc.

In one embodiment of the invention, better particulate cleaning may be obtained in the absence of water added to the dry-cleaning composition. There is inherently water present on or in the garments or articles to be cleaned as they are placed in the cleaning vessel. This water serves in part to adhere particulate soil to the articles to be cleaned. As the water is removed from the garments into the cleaning composition during the cleaning process, the removal of water from the article to be cleaned facilitates the removal of particulates from the articles to be cleaned. Thus, decreasing the amount of water originally in the cleaning system can serve to facilitate the cleaning of particulate soil from the articles to be cleaned by the action of the water inherently carried by the article to be cleaned.

Liquid dry-cleaning compositions useful for carrying out the present invention typically comprise:

(a) from zero (0), 0.02, 0.05 or 0.1 to 5 or 10 percent (more preferably from 0.1 to 4 percent) water;

(b) carbon dioxide (to balance; typically at least 30 percent);

(c) surfactant (preferably from 0.1 or 0.5 percent to 5 or 10 percent total, which may be comprised of one or more different surfactants); and (d) from 0.01 or 0.1 to 50 percent (more preferably 1, 2 or 4 percent to 30 percent) of an organic co-solvent.

Percentages herein are expressed as percentages by weight unless otherwise indicated.

The composition is provided in liquid form at ambient, or room, temperature, which will generally be between zero and 50° Centigrade. The composition is held at a pressure that maintains it in liquid form within the specified temperature range. The cleaning step is preferably carried out with the composition at ambient temperature.

The organic co-solvent is, in general, a hydrocarbon co-solvent. Typically the co-solvent is an alkane co-solvent, with $C_{10}$ to $C_{20}$ linear, branched, and cyclic alkanes, and mixtures thereof (preferably saturated) currently preferred. The organic co-solvent preferably has a flash point above 140° F., and more preferably has a flash point above 170° F. The organic co-solvent may be a mixture of compounds, such as mixtures of alkanes as given above, or mixtures of one or more alkanes. Additional compounds such as one or more alcohols (e.g., from 0 or 0.1 to 5% of a C1 to C15 alcohol (including diols, triols, etc.)) different from the organic co-solvent may be included with the organic co-solvent.

Examples of suitable co-solvents include, but are not limited to, aliphatic and aromatic hydrocarbons, and esters and ethers thereof, particularly mono and di-esters and ethers (e.g., EXXON ISOPAR L, ISOPAR M, ISOPAR V, EXXON EXXSOL, EXXON DF 2000, CONDEA VISTA LPA-170N, CONDEA VISTA LPA-210, cyclohexanone, and dimethyl succinate), alkyl and dialkyl carbonates (e.g., dimethyl carbonate, dibutyl carbonate, di-t-butyl dicarbonate, ethylene carbonate, and propylene carbonate), alkylene and polyalkylene glycols, and ethers and esters thereof (e.g., ethylene glycol-n-butyl ether, diethylene glycol-n-butyl ethers, propylene glycol methyl ether, dipropylene glycol methyl ether, tripropylene glycol methyl ether, and dipropylene glycol methyl ether acetate), lactones (e.g., (gamma)butyrolactone, (epsilon)caprolactone, and (delta) dodecanolactone), alcohols and diols (e.g., 2-propanol, 2-methyl-2-propanol, 2-methoxy-2-propanol, 1-octanol, 2-ethyl hexanol, cyclopentanol, 1,3-propanediol, 2,3-butanediol, 2-methyl-2,4-pentanediol) and polydimethylsiloxanes (e.g. decamethyltetrasiloxane, decamethylpentasiloxane, and hexamethyldisloxane), etc.

Any surfactant can be used to carry out the present invention, including both surfactants that contain a $CO_2$-philic group (such as described in PCT Application WO96/27704) linked to a $CO_2$-phobic group (e.g., a lipophilic group) and (more preferably) surfactants that do not contain a $CO_2$-philic group (i.e., surfactants that comprise a hydrophilic group linked to a hydrophobic (typically lipophilic) group). A single surfactant may be used, or a combination of surfactants may be used.

Numerous surfactants are known to those skilled in the art. See, e.g., McCutcheon's Volume 1: Emulsifiers & Detergents (1995 North American Edition) (MC Publishing Co., 175 Rock Road, Glen Rock, N.J. 07452). Examples of the major surfactant types that can be used to carry out the present invention include the: alcohols, alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, diphenyl sulfonate derivatives, ethoxylated alcohols, ethoxylated alkylphenols, ethoxylated amines and/or amides, ethoxylated fatty acids, ethoxylated fatty esters and oils, fatty esters, fluorocarbon-based surfactants, glycerol esters, glycol esters, hetocyclic-type products, imidazolines and imidazoline derivatives, isethionates, lanolin-based derivatives, lecithin and lecithin derivatives, lignin and lignin deriviatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates, ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives, taurates, thio and mercapto derivatives, tridecyl and dodecyl benzene sulfonic acids, etc.

Additional examples of surfactants that can be used to carry out the present invention include alcohol and alkylphenol polyalkyl ethers(e.g., TERGITOL 15-S-3™ secondary alcohol ethoxylate, TRITON X-207™ dinonylphenol ethoxylate, NEODOL 91-2.5™ primary alcohol ethoxylate, RHODASURF BC-410™ isotridecyl alcohol ethoxylate, RHODASURF DA-63™ tridecyl alcohol ethoxylate) alkylaryl carbonates, including salts and derivatives thereof (e.g., acetic acid, MARLOWET 4530™ dialkylphenol polyethylene glycol acetic acid, MARLOWET 1072™ alkyl polyethylene glycol ether acetic acid), alkoxylated fatty acids (e.g., NOPALCOL 1-TW™ diethylene glycol monotallowate, TRYDET 2600™ polyqxyethylene (8) monostearate), alkylene oxide block copolymers (e.g., PLURONIC™ and TETRONIC™ products), acetylenic alcohols and diols (e.g., SURFYNOL™ and DYNOL™ products), mono- and di-esters of sulfosuccinic acid (e.g., AEROSOL OT™ sodium dioctyl sulfosuccinate, AEROSOL IB-45™ sodium diisobutyl sulfosuccinate, MACKANATE DC-50™ dimethicone copolyol disodium sulfosuccinate, SOLE TERGE-8™ oleic acid isopropanolamide monoester of sodium sulfosuccinate), sulfosuccinamic acid and esters thereof (e.g. AEROSOL 18™ disodium-N-octadecyl sulfosucciniamate, AEROSOL 22™ tetrasodium N-(1,2-dicarboxyethyl)-N octadecyl sulfosuccinamate) sorbitan esters including derivatives thereof (e.g., SPAN 80™ sorbitan monoleate, ALKAMULS 400-DO™ sorbitan dioleate, ALKAMULS STO™ sorbitan trioleate, TWEEN 81™ polyoxyethylene (5) sorbitan monoleate, TWEEN 21™ polyoxyethylene (4) sorbitan monolaurate), isothionates including derivatives thereof (e.g., GEROPON AC-270™ sodium cocoyl isothionate), polymeric alkylaryl compotunds and lignins, including derivatives thereof (e.g., LIGNOSITE 50™ calcium lignosulfonate), alkylaryl sulfonic acids and salts thereof (e.g., CALIMULSE EM-99™ branched dodecylbenzene sulfonic acid, WITCONATE C-50H™ sodium dodecylbenzene sulfonate, WITCONATE P10-59™ amine salt of dodecylbenzene sulfonate), sulfonated amines and amides (e.g., CALIMULSE PRS™ isopropylamine sulfonate), Betaine and sultaine derivatives, and salts thereof (e.g. lauryl sulfobetaine, dodecyldimethyl(3-sulfopropyl) ammonium hydroxide, FOAMTAIN CAB-A™ cocamidopropyl betaine ammonium salt, FOAMTAINE SCAB™ cocamidopropyl hydroxy sultaine), e.g., imidazolines including derivatives thereof (e.g., MONOAZOLINE O™ substituted imidazoline of oleic acid, MONOAZOLINE T™ substituted imidazoline of Tall Oil), oxazolines including derivatives thereof (e.g., ALKATERGE E™ oxazoline derivative, ALKATERGE T-IV™ ethoxylated oxazoline denvative), carboxylated alcohol or alkylphenol ethoxylates including derivatives thereof (e.g., MARLOSOL OL7™ oleic acid polyglycol ester), diphenyl sulfonates including derivatives thereof (e.g., DOWFAX™ detergent diphenyl oxide disulfonate, DOWFAX™ dry detergent: sodium n-hexadecyl diphenyl oxide disulfonate, DOWFAX™ Dry hydrotrope: sodium hexyl diphenyloxide disulfonate) fluorinated surfactants (e.g., FLUORAD FC-120™ ammonium perfluoroalkyl sulfonate, FLUORAD FC-135™ fluoroalkyl quaternary ammonium iodides, FLUORAD FC-143™ ammnonium perfluoroalkyl carboxylates), lecithins including lecithin derivatives (e.g., ALCOLEC BS™ soy phosphatides), phosphate esters (e.g., ACTRAFOS SA-216™ aliphatic phosphate ester, ACTRAFOS 110™ phosphate ester of complex aliphatic hydroxyl compound, CHEMPHOS TC-310™ aromatic phosphate ester, CALGENE PE-112N™ phosphated mono- and diglycerides), sulfates and sulfonates of fatty acids (e.g., ACTRASOL PSR™ sulfated castor oil, ACTRASOL SR75™ sulfated oleic acid), sulfates of alcohols (e.g., DUPONOL C™ sodium lauryl sulfate, CARSONOL SHS™ sodium 2-ethyl-1-hexyl sulfate, CALFOAM TLS-40™ triethanolamine lauryl sulfate), sulfates of ethoxylated alcohols (e.g., CALFOAM ES-301™ sodium lauryl ether sulfate), amines, including salts and derivatives thereof (e.g., Tris (hydroxymethyl)aminomethane, ARMEEN™ primary alkylamines, ARMAC HT™ acetic acid salt of N-alkyl amines) amide sulfonates (e.g., GEROPON TC-42™ sodium N-coconut acid-N-methyl taurate, GEROPON TC 270™ soditun cocomethyl tauride), quaternary amines, including salts and derivatives thereof (e.g., ACCOSOFT 750™ methyl bis (soya amidoethyl)-N-polyethoxyethanol quaternary ammonium methyl sulfate, ARQUAD™ N-alkyl trimethyl ammonium chloride, ABIL QUAT 3272™ diquaternary polydimethylsiloxane), amine oxides (e.g., AMMONYX CO™ cetyl dimethylamine oxide, AMMONYX SO™ stearamine oxide), esters of glycerol, sucrose, glucose, sarcosine and related sugars and hydrocarbons including their derivatives (e.g., GLUCATE DO™ methyl glucoside dioleate, GLICEPOL 180™ glycerol oleate, HAMPOSYL AL-30™ ammonium lauroyl sarcosinate, HAMPOSYL M™ N-myristoyl sarcosine, CALGENE CC™ propylene glycol dicaprylate/dicaprate), polysaccharides including derivatives thereof (e.g., GLUCOPON 225 DK™ alkyl polysaccharide ether), protein surfactants (e.g., AMITER LGS-2™ dioxyethylene stearyl ether diester of N-lauroyl-L-glutamic acid, AMISOFT CA™ cocoyl glutamic acid, AMISOFT CS 11™ sodium cocoyl glutamate, MAYTEIN KTS™ sodium/TEA lauryl hydrolyzed keratin, MAYPON 4C™ potassium cocoyl hydrolyzed collagen), and including thio and mercapto derivatives of the foregoing (e.g., ALCODET™ polyoxyethylene thioether, BURCO TME™ ethoxylated dodecyl mercaptan), etc.

Thus the present invention may be carried out using conventional surfactants, including but not limited to the anionic or nonionic alkylbenzene sulfonates, ethoxylated alkylphenols and ethoxylated fatty alcohols described in Schollmeyer German Patent Application DE 39 04514 A1, that are not soluble in liquid carbon dioxide and which could not be utilized in the invention described in U.S. Pat. No. 5,683,473 to Jureller et al. or U.S. Pat. No. 5,683,977 to Jureller et al.

As will be apparent to those skilled in the art, numerous additional ingredients can be included in the dry-cleaning composition, including detergents, bleaches, whiteners, softeners, sizing, starches, enzymes, hydrogen peroxide or a source of hydrogen peroxide, fragrances, etc.

In practice, in a preferred embodiment of the invention, an article to be cleaned and a liquid dry cleaning composition as given above are combined in a closed drum. The liquid dry cleaning composition is preferably provided in an amount so that the closed drum contains both a liquid phase and a vapor phase (that is, so that the drum is not completely filled with the article and the liquid composition). The article is then agitated in the drum, preferably so that the article contacts both the liquid dry cleaning composition and the vapor phase, with the agitation carried out for a time sufficient to clean the fabric. The cleaned article is then removed from the drum. The article may optionally be rinsed (for example, by removing the composition from the drum, adding a rinse solution such as liquid $CO_2$ (with or without additional ingredients such as water, co-solvent, etc.) to the drum, agitating the article in the rinse solution, removing the rinse solution, and repeating as desired), after the agitating step and before it is removed from the drum. The dry cleaning compositions and the rinse solutions may be removed by any suitable means, including both draining and venting.

Any suitable cleaning apparatus may be employed, including both horizontal drum and vertical drum apparatus. When the drum is a horizontal drum, the agitating step is carried out by simply rotating the drum. When the drum is a vertical drum it typically has an agitator positioned therein, and the agitating step is carried out by moving (e.g., rotating or oscillating) the agitator within the drum. A vapor phase may be provided by imparting sufficient shear forces within the drum to produce cavitation in the liquid dry-cleaning composition. Finally, in an alternate embodiment of the invention, agitation may be imparted by means of jet agitation as described in U.S. Pat. No. 5,467,492 to Chao et al., the disclosure of which is incorporated herein by reference. As noted above, the liquid dry cleaning composition is preferably an ambient temperature composition, and the agitating step is preferably carried out at ambient temperature, without the need for associating a heating element with the cleaning apparatus.

The present invention is explained in greater detail in the following non-limiting examples.

EXAMPLES 1–2

This example shows that various $CO_2$ detergent formulations show a significantly enhanced cleaning effect over a commercial perchloroethylene ("perc") dry cleaning system. Small (2"×2") swatches of various delicate (often "dry clean only") cloth were uniformly stained and run in both perc and $CO_2$ cleaning systems. Two $CO_2$ cleaning systems were employed, as follows:

FIRST

- 0.5% X-207 (a commercial detergent from Union Carbide di-nonyl phenyl ethoxylate with a hydrophobic-lipophilic balance (HLB) of about 10.5);
- 0.5% PDMS-$g_3$-PEG (polydimethyl siloxane-graft-polyethylene glycol copolymer) (500 g/mol PDMS with 350 g/mol peg grafts ca. 50 wt % PEG);
- 1% Span™ 80 (a commercial sorbitan ester surfactant from ICI);
- 0.5% isopropanol;
- 0.2% water;
- 30% Isopar™ M (a commercial hydrocarbon solvent manufactured by EXXON); and
- $CO_2$ to balance; or

SECOND

- 1% X-207;
- 1% Span™ 80;

1% isopropanol;

0.2% water;

30% Isopar™ M; and $CO_2$ to balance.

The second system above is currently preferred.

At a temperature of 22° C. to 27° C., the formulation and cloth was added to the test vessel. The test vessel was presurized with liquid $CO_2$ to 800–900 psi, with the total liquid volume equal to about half the vessel volume. The cloth was washed with agitation for ten minutes. To rinse, the liquid $CO_2$ was vented, the cloth spun for five minutes, liquid $CO_2$ was again added and pressurized to 800 to 900 psi until the vessel was one half full, and the cloth again agitated for five minutes. The rinse cycle (vent, spin, agitate) was repeated, the system vented and the cloth removed.

Control "perc" samples were run in perchloroethylene using a standard loading of Fabritech™ detergent and sizing, at a local commrcial dry cleaner under normal operating conditions. In each case the stained samples of cloth were washed in one of the $CO_2$ mixtures described above, followed by extraction and rinse with clean $CO_2$.

The following cloth samples were run:

1. White linen suiting
2. Acetate taffeta
3. Silk twill
4. 100% wool flannel
5. Bright filament viscose twill
6. Texturized nylon 6,6 stretch fabric
7. Texturized stretch Dacron™

Results are given in Table 1 below. These data show that $CO_2$-based dry cleaning formulations of the present invention have an enhanced cleaning effect as compared to a commercial PERC dry cleaning system.

TABLE 1

| Cloth | Stain | PERC result | CO2 result |
|---|---|---|---|
| 2, 4, 1 | French salad dressing | slight residue remaining | visually clean, no residue |
| 1, 2, 3, 4, 6 | Spaghetti sauce | majority of stain remaining | slight residue remaining |
| 5 | Tea | over ½ of residue remaining, plus darkening of 'ring' around the stained area | slight residue remaining, no 'ring' apparent |
| 2 | Tea | slight residue remaining | visually clean, no residue |
| 5 | Blackberry juice | slight residue remaining | visually clean, no residue |
| 4, 5, 7 | Grass | slight residue remaining | minute residue remaining[1] |
| 4 | Coke ™ cola beverage | ½ of stain remaining | minute residue remaining |
| 4 | Coffee | ½ of stain remaining | minute residue remaining |
| 1 | Egg | no significant removal of stain, slight color change of stain | slight residue remaining |
| 1, 2, 4, 6 | taco sauce | majority of stain remaining | slight residue remaining |

[1]By "minute" is meant significantly less than the perc result.

EXAMPLE 3

An additional liquid carbon dioxide cleaning system, or wash fluid, that can be used in the methods described herein, is a mixture that contains:

2.86% ISOPAR M™ organic solvent;

1.23% DPMA (dipropyleneglycol menomethyl ether acetate);

0.56% TERGITOL 15-S-3™ (Union Carbide secondary alcohol ethoxylate with an HLB of 8.3);

0.28% water;

0.05% TRITON GR-7M™ (commercial detergent from Union Carbide—sodium dioctylsulfosuccinate in petroleum distillates);

0.02% TRITON RW-20™ (conmmercial detergent from Union Carbide—ethoxylated alkylamines); and liquid carbon dioxide to balance.

EXAMPLE 4

An additional example of a liquid dry cleaning system useful for carrying out the present invention is a mixture that contains:

2.80% DPM (dipropyleneglycol monomethyl ether);

1.20% hexylene glycol;

0.50% TERGITOL 15-S-3™ detergent;

0.50% water; and liquid carbon dioxide to balance.

EXAMPLE 5

An additional example of a liquid dry cleaning system useful for carrying out the present invention is a mixture that contains:

2.80% DPM;

1.20% hexylene glycol;

0.50% TERGITOL 15-S-3™ detergent;

0.40% water;

0.10% C-300™ (commercial detergent formulation from ADCO containing quaternary amines and optical brighteners); and carbon dioxide to balance.

EXAMPLE 6

An additional example of a liquid dry cleaning system useful for carrying out the present invention is a mixture that contains:

2.80% ISOPAR M™ organic solvent;

1.20% DPMA;

0.50% water;

0.35% EMCOL 4500™ (a commercial detergent from Witco-70% dioctyl sodium sulfonate, 30% ethanol, 10% water)

0.15% ACTRAFOS 110™ (Commercial detergent from Actrachem-phosphate ester of complex aliphatic hydroxyl compound); and liquid carbon dioxide to balance.

EXAMPLE 7

An additional example of a liquid carbon dioxide dry cleaning system that can be used to carry out the present invention is a mixture that contains:

2.80% TPM (tripropyleneglycol monomethyl ether);

1.20% propylene carbonate;

0.50% PLURONIC L31™ (commercial detergent from BASF-polyethylene oxide-polypropylene oxide block copolymer);

0.40% water;

0.10% lauryl sulfobetaine; and liquid carbon dioxide to balance.

EXAMPLE 8

An additional example of a liquid carbon dioxide dry cleaning system that can be used to carry out the present invention is a mixture that contains:

2.80% ISOPAR M™ organic solvent;

1.20% DPMA;

0.60% PLURONIC L31™ detergent;

0.60% water;

0.10% cyclohexanol; and liquid carbon dioxide to balance.

EXAMPLE 9

An additional example of a liquid carbon dioxide dry cleaning system that can be used to carry out the present invention is a mixture that contains:

4.0% ISOPAR M™ organic solvent;

0.7% sodium dioctylsulfosuccinate;

0.3% water; and liquid carbon dioxide to balance.

EXAMPLE 10

An additional example of a liquid carbon dioxide dry cleaning system that can be used to carry out the present invention is a mixture that contains:

4.00% ISOPAR M™ organic solvent;

0.62% WITCONATE P1059™ (commercial detergent of Witco-isopropylamine salt of dodecylbenzene sulfonate);

0.35% water;

0.03% TRIS™ pH buffer (tris[hydroxymethyl] aminomethane); and liquid carbon dioxide to balance.

EXAMPLE 11

An additional example of a liquid carbon dioxide dry cleaning system that can be used to carry out the present invention is a mixture that contains:

4.2% ISOPAR M™ organic solvent;

0.24% water;

0.196% TRITON™ RW-20 (commercial detergent available from Union Carbide; a secondary amine ethoxylate);

0.048% TRITON™ GR-7M detergent (a commercial detergent of Union Carbide; sodium dioctyl sulfosuccinate in aromatic and aliphatic hydrocarbons)

0.48% TERGITOL™ 15-S-3 detergent (a commercial detergent of Union Carbide; a secondary alcohol ethoxylate); and liquid carbon dioxide to balance.

EXAMPLE 12

An additional example of a liquid carbon dioxide dry cleaning system that can be used to carry out the present invention is a mixture that contains:

3.07% ISOPAR M™ organic solvent;

1.32% DPMA (diopropylene glycol monomethyl ether acetate);

0.087% water;

0.023% TRITON™ GR-7M detergent (a commercial detergent of Union Carbide; sodium dioctyl sulfosuccinate in aromatic and aliphatic hydrocarbons)

0.5% TERGITOL™ 15-S-3 detergent (a commercial detergent of Union Carbide; a secondary alcohol ethoxylate); and liquid carbon dioxide to balance.

The liquid dry cleaning systems of Examples 11 and 12 are currently referred.

EXAMPLE 13

An additional example of a liquid carbon dioxide dry cleaning system that can be used to carry out the present invention, particularly useful for the cleaning of particulate soil, is a mixture that contains:

4.2% ISOPAR M™ organic solvent;

0.196% TRITON™ RW-20 (commercial detergent available from Union Carbide; a secondary amine ethoxylate);

0.048% TRITON™ GR-7M detergent (a commercial detergent of Union Carbide; sodium dioctyl sulfosuccinate in aromatic and aliphatic hydrocarbons)

0.48% TERGITOL™ 15-S-3 detergent (a commercial detergent of Union Carbide; a secondary alcohol ethoxylate); and liquid carbon dioxide to balance.

EXAMPLE 14

An additional example of a liquid carbon dioxide dry cleaning system that can be used to carry out the present invention, also particularly useful for cleaning particulate soil, is a mixture that contains:

3.07% ISOPAR M™ organic solvent;

1.32% DPMA (diopropylene glycol monomethyl ether acetate);

0.023% TRITONT™ GR-7M detergent (a commercial detergent of Union Carbide; sodium dioctyl sulfosuccinate in aromatic and aliphatic hydrocarbons)

0.5% TERGITOL™ 15-S-3 detergent (a commercial detergent of Union Carbide; a secondary alcohol ethoxylate); and liquid carbon dioxide to balance.

The foregoing is illustrative of the present invention, and is not to be construed as limiting thereof. The invention is defined by the following claims, with equivalents of the claims to be included therein.

That which is claimed is:

1. A liquid dry-cleaning composition, useful for carrying out dry cleaning in carbon dioxide at or about room temperature and vapor pressure, said composition comprising by weight:

(a) from 0.02 to 10 percent water;

(b) carbon dioxide;

(c) from 0.1 to 10 percent surfactant; and (d) from 0.01 to 50 percent of an organic co-solvent;

wherein said surfactant does not contain a $CO_2$-philic group.

2. A composition according to claim 1, wherein said organic co-solvent has a flash point above 140° F.

3. A composition according to claim 1, wherein said organic co-solvent has a flash point above 170° F.

4. A composition according to claim 1, wherein said organic co-solvent has a flash point above 200° F.

5. A composition according to claim 1, wherein said organic co-solvent is a hydrocarbon co-solvent.

6. A composition according to claim 1, wherein said organic co-solvent is an alkane co-solvent.

7. A composition according to claim 1, further comprising an alcohol.

* * * * *